United States Patent [19]

Chang

[11] Patent Number: 4,769,923

[45] Date of Patent: Sep. 13, 1988

[54] DRYER FOR DRYING A PRODUCT-LADEN AIR STREAM AS SPIRALLY FLOATED

[76] Inventor: Yen-Nien Chang, P.O. Box 10160, Taipei, Taiwan

[21] Appl. No.: 93,597

[22] Filed: Sep. 8, 1987

[51] Int. Cl.[4] ..... F26B 17/00

[52] U.S. Cl. ..... 34/57 R; 34/136

[58] Field of Search ..... 34/57 R, 57 A, 10; 432/58

[56] References Cited

U.S. PATENT DOCUMENTS 664,903 1/1901 Seldner ..... 34/136

3,276,627 10/1966 Birkestrand ..... 34/136

*Primary Examiner*—Henry A. Bennet

[57] ABSTRACT

A dryer includes: a housing, an eddy-flow turbo fan having an inner cylinder formed with plural blades each having an inclined groove protruding upwardly outwardly and backwardly relative to the rotating direction of the fan to be tangential to the inner periphery of the inner cylinder and an outer cylinder formed with plural blades each protruding upwardly inwardly and backwardly to be tangential to the outer periphery of the outer cylinder, a heater disposed around the fan, a wet feed means fluidically communicated to a lower hopper of the fan, and a dry discharge means fluidically communicated with an upper annular port of the fan, whereby upon the rotation of the fan, a hot air stream as heated by the heater will be guided inwardly upwardly by the outer cylinder and the other hot air stream will be guided outwardly upwardly by the inner cylinder to thereby form an eddy air flow to dry the wet product as spirally floated on the eddy air stream in an efficient and economic way.

8 Claims, 5 Drawing Sheets

DRYER FOR DRYING A PRODUCT-LADEN AIR STREAM AS SPIRALLY FLOATED

BACKGROUND OF THE INVENTION

A conventional turbo-tray dryer as shown in FIG. 10 is a continuous dryer consisting of a stack of rotating annular shelves S in the center of which turbo-type fans T revolve to circulate the air over the shelves. Wet material F enters through the roof, falling onto the top shelf as it rotates beneath the feed opening. After completing one revolution, the material is wiped by a stationary wiper W through radial slots on an upper shelf to a lower shelf where it is spread into a uniform pile by a stationary leveler L. The action is repeated on each shelf, with transfers occurring once each revolution. From the last shelf, material is discharged through the bottom of the dryer D and the air A is exhausted through an upper stack. However, such a turbo-tray dryer still has the following defects:

1. In order to wipe the drying material on an upper shelf to a lower shelf for its uniform drying, a plurality of wipers and levelers must be provided to increase their installation cost and maintenance problems.

2. As shown in FIG. 10, the hot air stream, flowing radially over each shelf as driven by the turbo fans as guided by the plural annular shelves stacked vertically, will reciprocatively impact the housing wall and the shelves to cause turbulent flow and energy loss, thereby reducing the dryer efficiency.

3. The dried product as wiped onto the lower shelves will become light to be floated and laden on rising air stream to possibly clog the suction ports or blades of the fans.

The present inventor has found the defects of such a conventional turbo-tray dryer and invented the present dryer exerting a spirally floating air stream.

SUMMARY OF THE INVENTION

The object of the present invention is to provide a dryer including: a housing, an eddy-flow turbo fan having an inner cylinder formed with plural blades each having an inclined groove protruding upwardly outwardly and backwardly relative to the rotating direction of the fan to be tangential to the inner periphery of the inner cylinder and an outer cylinder formed with plural blades each protruding upwardly inwardly and backwardly to be tangential to the outer periphery of the outer cylinder, a heater disposed around the fan, a wet feed means fluidically communicated to a lower hopper of the fan, and a dry discharge means fluidically communicated with an upper annular port of the fan, whereby upon the rotation of the fan, a hot air stream as heated by the heater will be guided inwardly upwardly by the outer cylinder and the other hot air stream will be guided outwardly upwardly by the inner cylinder to thereby form an eddy air flow to dry the wet product as spirally floated on the eddy air stream in an efficient and economic way.

DETAILED DESCRIPTION

Figure 1:
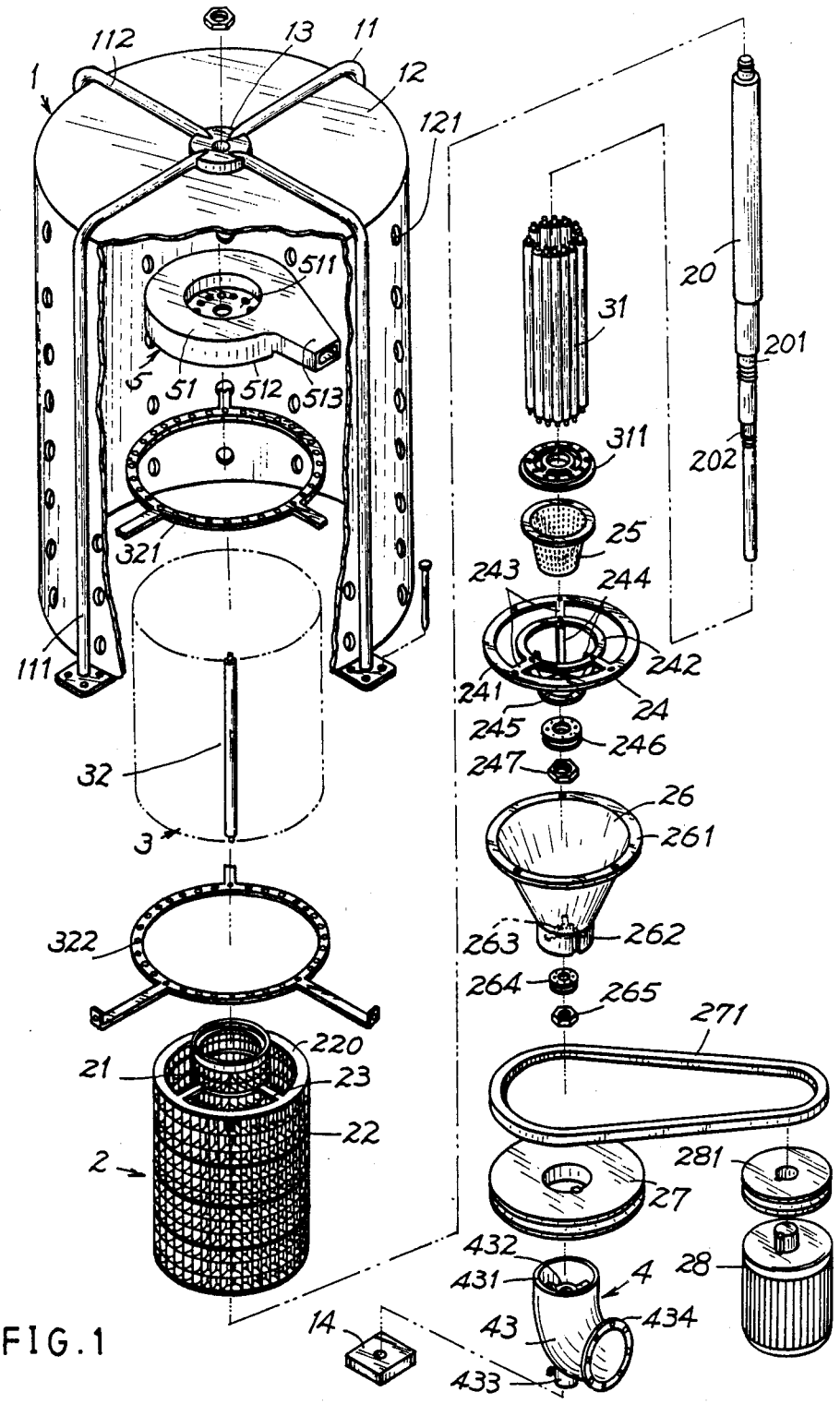
FIG. 1 is an exploded view of all elements construcing the present invention.
Figure 2:
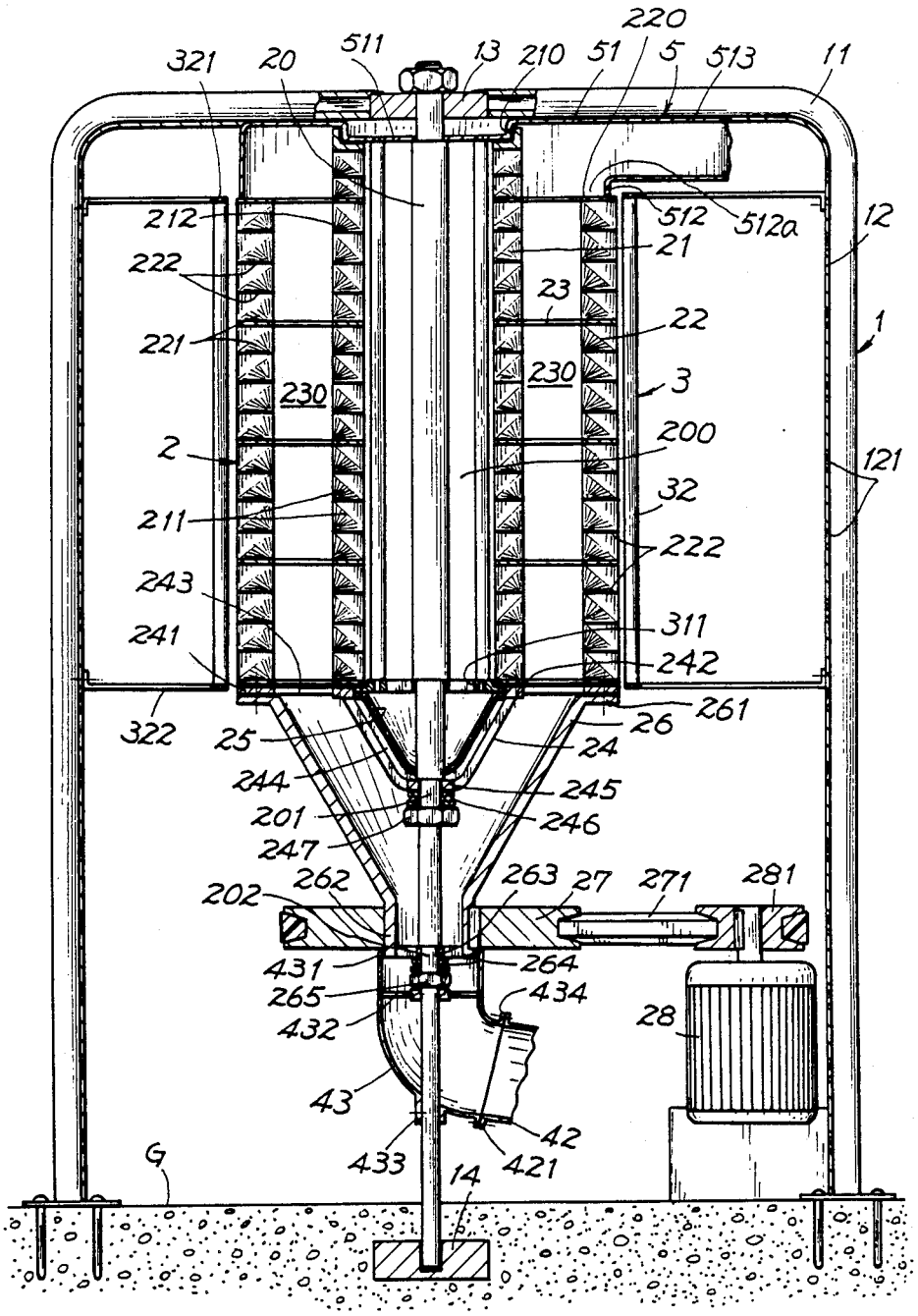
FIG. 2 is an elevational view of the present invention as assembled.

As shown in FIGS. 1, 2, 3, 4 and 9, the present invention comprises: a housing 1, an eddy-flow turbo fan 2, a heater 3, a wet feed means 4, and a dry discharge means 5.

The housing 1 includes: a supporting frame 11 having vertical columns 111 mounted on a ground floor G and horizontal beams 112 for suspending the turbo fan 2 thereunder, a cylindrical casing 12 encasing the fan 2 and heater 3 therein as defined and retained in the supporting frame 11 and drilled with plural ventilating holes 121 for the entrance of an environmental air, a collar 13 formed on a central portion of the horizontal beams 112, and a bottom pad 14 mounted under the ground G, both the collar 13 and pad 14 being adapted for mounting a vertical shaft 20 of the fan 2.

The eddy-flow turbo fan 2 includes: a vertical central shaft 20 mounted in the housing 1, an inner cylinder 21, an outer cylinder 22, plural radial baffles 23 each connecting the inner cylinder 21 and the outer cylinder 22, a fan retainer 24 secured under th two cylinders 21, 22 and rotatably mounted on a first lower portion 201 of the vertical central shaft 20, a filter 25 encased by the fan retainer 24 and fixed on the central shaft 20, a lower hopper 26 having its upper flange 261 secured under the outer cylinder 22 and having its lower tapered neck portion 262 rotatably mounted on a second lower portion 202 of the shaft 20 under the first lower portion 201, a follower wheel 27 fixed on the tapered portion 262 of the hopper 26, and a driving motor 28 having a driving wheel 281 coupled to the follower wheel 27 by a transmission belt 271.

The inner cylinder 21 is formed with a plurality of inner blades 211 annularly disposed on plural annular plates 212 which are vertically stacked to form multiple storeys of annular blades 211. The upper portion of the cylinder 21 is formed with a disk having an annular groove 210 formed thereon.

Figure 3:
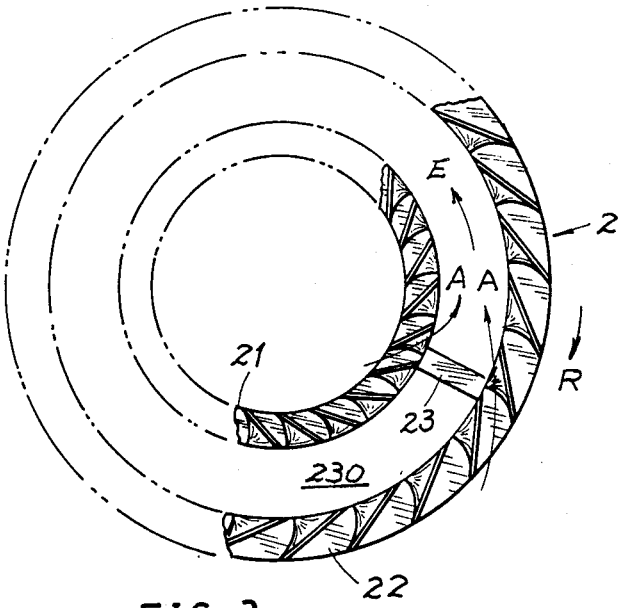
FIG. 3 is a top-view illustration showing the inner and outer cylinders of the present invention.

Each inner blade 211 is outwardly curved to form a first inclined groove **211*a* protruding upwardly, outwardly and backwardly, relative to a forward rotation (R) of the cylinder 21, to be generally tangential to an inside periphery of the cylinder 21 to thereby guide air flowing in direction A into a main annular space 230 defined between the two cylinders as shown in FIG. 3**.

The outer cylinder 22 is formed with a plurality of outer blades 221 annularly disposed on plural annular plates 222 which are vertically stacked to form multiple storeys of annular blades 221. The upper portion of the cylinder 22 is formed with a top annular plate 220.

Each outer blade 221 is inwardly curved to form a second inclined groove **221*a* corresponding to the first groove 211*a*** protruding upwardly, inwardly and backwardly, relative to a forward rotation (R) of the cylinder 22, to be generally tangential to an outside periphery of the cylinder 22 to thereby guide air flowing in direction A into the main annular space 230 defined between the two cylinders. Between the inner cylinder 21 and the central shaft 20, there is formed a central annular space 200. The air inlet pressure from the outer cylinder 22 should be generally equal to the air inlet pressure as directed from the inner cylinder 21 to enforce the smooth upwardly spiral flow E of this invention.

The fan retainer 24 includes: a radial grating 243 secured between an outer ring 241 fixed under the outer cylinder 22 and an inner ring 242 fixed under the inner cylinder 21, a cone-shaped grating 244 secured between the upper inner ring 242 and a lower collar 245 which is rotatably mounted with the first lower portion 201 of the central shaft 20 by a thrust bearing 246 as limited by a nut 247 fixed on the shaft 20. The cone-shaped grating 244 are rotatably tangential to the periphery of the filter 25 as cone shaped so as to scrape any wet material clogging on the filter 25.

The lower hopper 26 further includes a lower radial grating 263 inserted in the lower tapered neck portion 262 rotatably mounted on the second lower portion 202 of the shaft 20 by a thrust bearing 264 as limited by a nut 265.

The heater 3 includes: plural inner heating elements 31 radially disposed around the central shaft 20 and positioned adjacent to the inside periphery of the inner cylinder 21 as secured between a circular extension 511 of an upper hood 51 and a central radial grating 311 fixed on the central shaft 20; and plural outer heating elements 32 radially disposed around the outer cylinder 22 as secured by an upper bracket 321 and a lower bracket 322 fixed on the housing 1. The cone-shaped filter 25 has its upper flange fixed under the grating 311 and has its lower collar mounted on the shaft 20. The inner heating elements 31 may be electrically connected to a power source by electric wires which may pass through the central shaft (not shown), without being tangled by the rotating fan 2.

Figure 9:
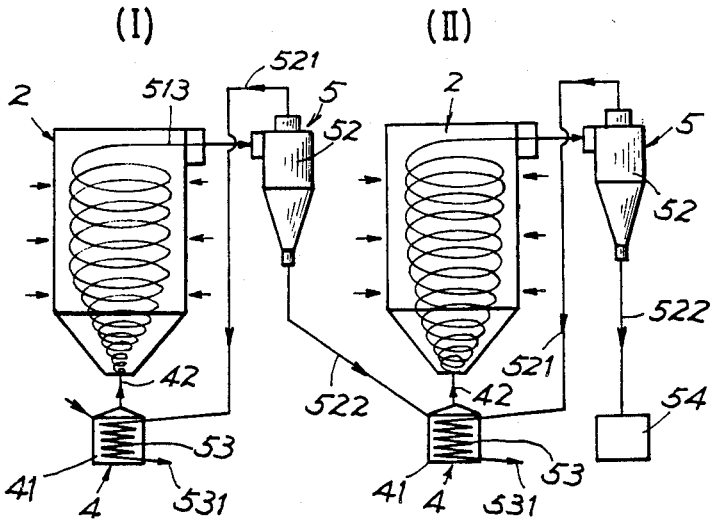
FIG. 9 shows a multiple-effect application of the present invention.
Figure 10:
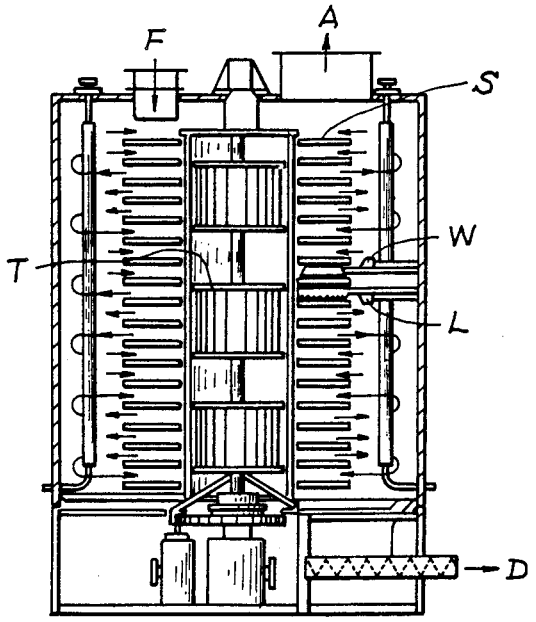
FIG. 10 PRIOR ART
FIG. 10 shows a conventional turbo-tray dryer.

The wet feed means 4 includes a feeder bin 41 placed under the fan 2 as shown in FIG. 9, a suction hose 42 connected with the bin 41 and a coupling elbow 43 of which a lower flange 434 is secured with a flange 421 of the suction hose 42, and an upper opening 431 rotatably engaged with the neck portion 262 having a retainer grating 432 limited by the nut 265, and a lower tube 433 protruding downwardly to jacket on the shaft 20, adapted for sturdily fixing the elbow 43 on the shaft 20.

The dry discharge means 5 includes: an upper hood 51 having a central extension 511 recessed downwardly to rotatably engage the annular groove 210 of the inner cylinder 21, an outer extension 512 rotatably contacting the top annular plate 220 of the outer cylinder 22 defining a discharge port 220 communicated with the main annular space 230 of the fan 2, and a discharge duct 513 connected to a product/air separator 52 preferably selected from a cyclone; the product/air separator 52 having an air pipe 521 connected with a coil 53 passing through the feeder bin 41 for preheating the wet feed and terminated with a blow pipe 531 to exhaust the waste air; and a dry product collector 54 connected to a lower portion of the separator 52 by a downcomer product pipe 522. For reducing the moisture content as carried in the inlet air, a dehumidifier 6 may be provided beyond a closed housing 1 to enhance the drying efficiency of the present invention. Such a dehumidifier is wellknown in the art and not claimed in this invention.

Figure 4:
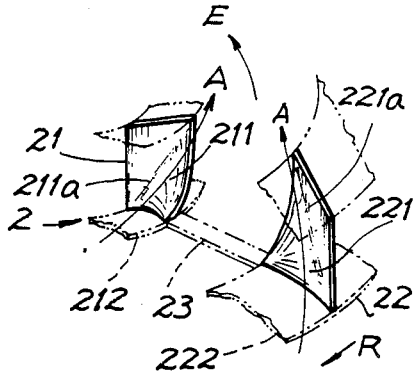
FIG. 4 is a partial illustration showing the blades of both cylinders of the present invention.

In using the present invention, the heater 3 and the motor 28 is actuated to start the rotation of the fan 2 whereby one air stream is directed through the incined grooves on the outer cylinder 22 and heated by the outer heating elements 32, and the other air stream is directed through the hopper 26, the filter 25 and the inclined grooves on the inner cylinder 21 and heated by the inner heating elements 31 so that both air streams will be fluidically combined to form an eddy flow E of air stream as shown in FIGS. 3 and 4 which will then form a spiral draft to suck the wet feed as delivered through the hose 42, the hopper 26 and the main annular space 230 to thereby be heated and dried by the eddy-flow air streams. The dried product as spirally floated in the air stream will be discharged through the discharge duct 513 into the separator 52 to thereby collect the product through a downcomer pipe 522, and the hot air stream is directed by an air pipe 521 to preheat the wet feed in the feeder bin 41 by a coil 53 connected with the pipe 521 for energy-saving purpose as shown in FIG. 9. FIG. 9 shows a two-stage dryer including a primary dryer I and a secondary dryer II wherein the dried product from primary dryer I is fed into bin 41 for further drying by the secondary dryer II and the final dried product is collected into collector 54. Naturally, the present invention can be modified to be a multiple-stage dryer system for industrial mass production.

Figure 5:
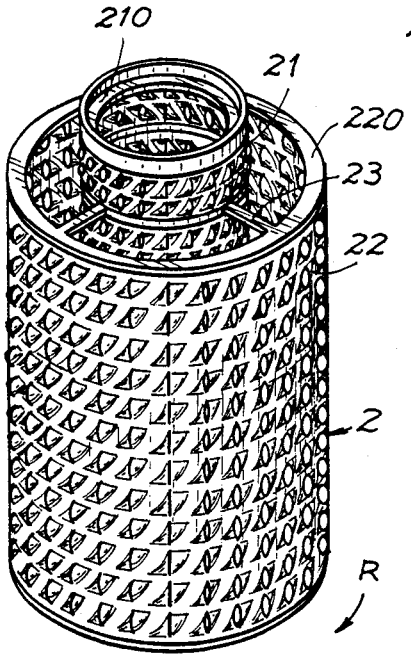
FIG. 5 is a perspective view showing two cylinders of another preferred fan of the present invention.
Figure 6:
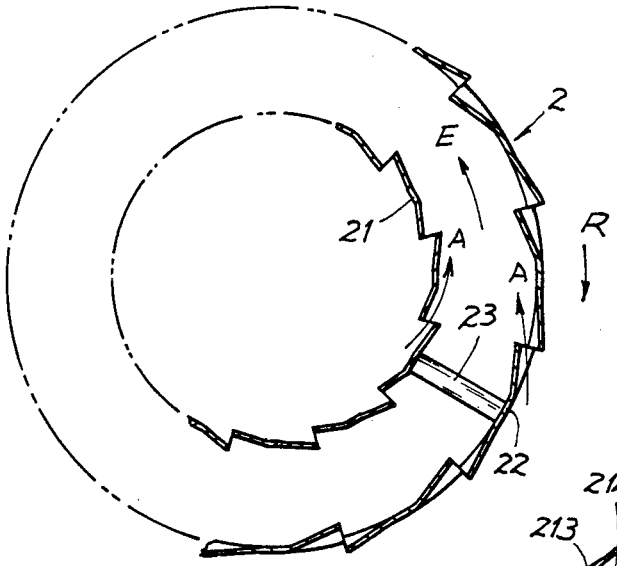
FIG. 6 is a top-view illustration of two cylinders of the present invention as shown in FIG. 5.
Figure 7:
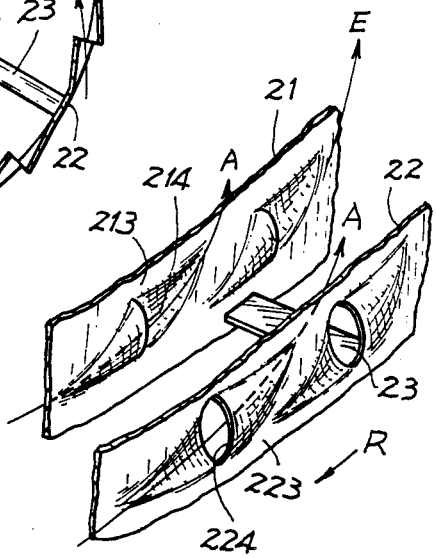
FIG. 7 is a partial perspective view of the two cylinders of the present invention as shown in FIG. 5.
Figure 8:
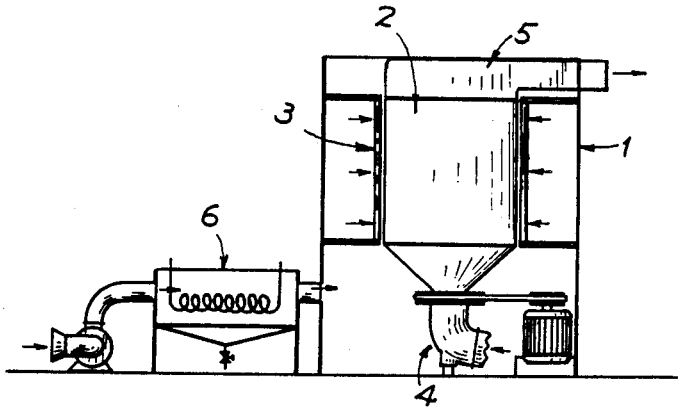
FIG. 8 shows a dehumidifier as added into the present invention.

Another preferred embodiment of the two cylinders 21, 22 of the present fan is shown in FIGS. 5–7, in which the inner cylinder 21 is punched to form a plurality of inner blades 213 annularly distributed on the cylinder wall to form multiple storeys of annular blades 213. Each inner blade 213 is punched inwardly to form an inclined groove 214 protruding upwardly, outwardly and backwardly relative to the forward rotation R of the cylinder 21 to be generally tangential to the periphery of the cylinder 21. The outer cylinder 22 is punched to form a plurality of outer blades 223 annularly distributed on the cylinder wall corresponding to the inner blades 213 to form multiple storeys of annular blades 223. Each outer blade 223 is punched outwardly to form an inclined groove 224 protruding upwardly, inwardly and backwardly relative to the forward rotation of the cylinder to be generally tangential to the periphery of the outer cylinder 22. Therefore, upon the rotation of the two cylinders 21, 22 of the fan 2, the two air streams as directed (A) by the two incined grooves 214, 224 will be fluidically combined to form an eddy flow E as shown in FIGS. 6 and 7 to have the spiral floating effect as aforementioned.

The present invention is superior to a conventional turbo-tray dryer with the following advantages:

1. The product/air stream is spirally directed in a smoother way to reduce the impact energy loss or frictional loss due to turbulent flow of a conventional dryer.

2. The installation, operation and maintenance cost of this invention will be much less than that of the turbo-tray dryer due to the elimination of those wipers, levelers and trays.

3. The wet feed is automatically sucked and floated by the eddy-flow air streams and upwardly discharging by the fan draft of this invention to thereby furnish an easier, more efficient drying operation.

I claim:

1. A dryer comprising:

a housing having a supporting frame comprised of vertical columns mounted on a ground floor and horizontal beams, and a cylindrical casing retained within said supporting frame and drilled with plural ventilating holes for air entrance;

an eddy-flow turbo fan including: a vertical central shaft fixed under a central collar of said horizontal beams of said housing, an inner cylinder secured by means of plural radial baffles with an outer cylinder, a fan retainer secured under said two cylinders rotatably mounted on a first lower portion of said central shaft, a filter encased by said fan retainer and fixed on said shaft, a lower hopper having its upper flange secured under said outer cylinder and having its lower tapered neck portion rotatably mounted on a second lower portion, under said first lower portion, of said shaft and driven by a driving motor, both said cylinders being formed with plural inclined grooves thereon each groove protruding upwardly and backwardly relative to a forward rotation of said fan to be generally tangential to its corresponding cylinder periphery, adapted to guide air streams flowing in eddy flow into an annular space defined by said two cylinders for spirally floating wet product as laden on said air streams;

a heater including plural inner heating elements radially disposed around said central shaft and adjacent to said inner cylinder, and plural outer heating elements radially disposed around said outer cylinder;

a wet feed means including a feeder bin placed under said fan, a suction hose connected with said bin and a coupling elbow connected with said hose and rotatably engaged with the lower neck portion of said hopper of said fan; and a dry discharge means including an upper hood rotatably mounted on the top portion of two said cylinders and fluidically communicated with said annular space defined by said two cylinders, a product-/air separator connected with said hood by a discharge duct, a product downcomer pipe leading to a dry product collector from said separator, and an air pipe connected with a coil passing through said feeder bin for preheating the wet feed inside said bin.

2. A dryer according to claim 1, wherein said inner cylinder is formed with a plurality of inner blades annularly disposed on plural annular plates which are vertically stacked to form multiple storeys of annular inner blades, each said inner blade outwardly curved to form a first inclined groove protruding upwardly, outwardly and backwardly, relative to a forward rotation of said cylinders, to be generally tangential to an inside periphery of said inner cylinder, thereby adapted to guide air flowing into said annular space between said two cylinders.

3. A dryer according to claim 1, wherein said outer cylinder is formed with a plurality of outer blades annularly disposed on plural annular plates which are vertically stacked to form multiple storeys of annular outer blades, each said outer blade inwardly curved to form a second inclined groove corresponding to said first inclined groove protruding upwardly, inwardly and backwardly to be generally tangential to an outside periphery of said outer cylinder to guide air flowing into said annular space between said cylinders to form an eddy air flow fluidically combined with the air flowing through said first grooves.

4. A dryer according to claim 1, wherein said inner cylinder, said central shaft and said filter as retained by said fan retainer define a central annular space adapted for directing a central air stream outwardly flowing through said inner cylinder to combine with the other air stream flowing through said outer cylinder.

5. A dryer according to claim 1, wherein said inner cylinder is punched to form a plurality of inner blades annularly distributed on the inner cylinder wall to form multiple storeys of annular inner blades, each said inner blade being punched inwardly to form an inclined groove protruding upwardly, outwardly and backwardly relative to the forward rotation of said inner cylinder to be generally tangential to the periphery of said inner cylinder.

6. A dryer according to claim 1, wherein said outer cylinder is punched to form plural outer blades annularly distributed on said outer cylinder wall corresponding to said inner blades on said inner cylinder to form multiple storeys of annular outer blades, each said outer blade being punched outwardly to form an inclined groove protruding upwardly, inwardly and backwardly relative to the forward rotation of said cylinders to be generally tangential to the periphery of said outer cylinder.

7. A dryer according to claim 1, wherein said fan retainer includes a radial grating secured between an outer ring fixed under said outer cylinder and an inner ring fixed under said inner cylinder, a cone-shaped inclined grating secured between the upper inner ring and a lower collar rotatably mounted on said central shaft by a thrust bearing as limited by a nut fixed on said shaft, the cone-shaped grating being rotatably tangential to the periphery of said filter to scrape any material clogging said filter.

8. A dryer according to claim 1, wherein an air inlet pressure as directed from said outer cylinder should be generally equal to an air inlet pressure as directed from said inner cylinder.

* * * * *